US005968723A

United States Patent [19]

Suzuki et al.

[11] Patent Number: 5,968,723

[45] Date of Patent: Oct. 19, 1999

[54] SILVER HALIDE COLOR PHOTOGRAPHIC LIGHT SENSITIVE MATERIAL

[75] Inventors: Takatugu Suzuki; Shuichi Sugita, both of Hino, Japan

[73] Assignee: Konica Corporation, Japan

[21] Appl. No.: 08/864,132

[22] Filed: May 28, 1997

[30] Foreign Application Priority Data

Jun. 3, 1996 [JP] Japan ..... 8-140128
Jun. 27, 1996 [JP] Japan ..... 8-167436

[51] Int. Cl.[6] ..... G03C 1/08; G03C 7/26; G03C 7/32

[52] U.S. Cl. ..... 430/558; 430/551

[58] Field of Search ..... 430/558, 551

[56] References Cited

U.S. PATENT DOCUMENTS 5,100,772 3/1992 Chen et al. ..... 430/558
5,254,451 10/1993 Kita et al. ..... 430/558
5,565,313 10/1996 Ishidai et al. ..... 430/558
5,576,150 11/1996 Tang et al. ..... 430/558
5,605,788 2/1997 Kawagishi et al. ..... 430/558
5,609,996 3/1997 Tang et al. ..... 430/558
5,656,418 8/1997 Nakamine et al. ..... 430/558
5,667,952 9/1997 Tang et al. ..... 430/558

*Primary Examiner*—Geraldine Letscher
*Attorney, Agent, or Firm*—Jordan B. Bierman; Bierman, Muserlian and Lucas

[57] ABSTRACT

A silver halide color photographic light sensitive material is disclosed, comprising a support having thereon photographic component layers including a blue-sensitive silver halide emulsion layer, green-sensitive silver halide emulsion layer and a red-sensitive silver halide emulsion layer, wherein the green-sensitive silver halide emulsion layer comprises a magenta coupler represented by the following formula:

2 Claims, No Drawings

SILVER HALIDE COLOR PHOTOGRAPHIC LIGHT SENSITIVE MATERIAL

FIELD OF THE INVENTION

The present invention relates to a silver halide color photographic light sensitive material containing a magenta coupler and in particular to a silver halide color photographic light sensitive material containing a novel pyrazolotriazole magenta coupler which is superior in color forming property and color reproduction, forming color images stable to heat and light.

BACKGROUND OF THE INVENTION

As couplers generally employed in silver halide color photographic light sensitive materials, there are known a yellow coupler comprised of a open-chained ketomethylene compound, a magenta coupler comprised of a pyrazolone or pyrazolotriazole compound and a cyan coupler comprised of a phenol or naphthol compound.

5-Pyrazolone compounds have conventionally employed as a magenta coupler. Known pyrazolone magenta couplers are described in U.S. Pat. Nos. 2,600,788 and 3,519,429 and JP-A 49-111631 and 57-35858 (hereinafter, the expression, "JP-A" refers to unexamined and published Japanese Patent Application). However, as described in The Theory of the Photographic Process, Macmillan Co. 4th Edition (1977), page 356–358; Fine Chemical Vol.14, No.8 page 38–41 (published by CMC) and Abstracts of Annual Conference in 1985 of the Society of Photographic Science and Technology of Japan page 108–110, a dye formed from the pyrazolone magenta coupler has an unwanted side absorption and its improvement is desired.

On the other hand, as described in the above references, a dye formed from the pyrazolotriazole magenta coupler has no side absorption. This coupler is superior one, as described in the above references, U.S. Pat. Nos. 3,725,067, 3,758,309 and 3,810,761. However, light fastness of a azomethine dye formed from the pyrazolotriazole magenta coupler is markedly low, leading to deterioration in photographic performance of silver halide color photographic light sensitive material and particularly those used for prints.

Studies of improvements in the light fastness have been made so far. JP-A 59-125732, 61-282845, 61-292639 and 61-279855 disclose a technique in which a pyrazoloazole magenta coupler is employed in combination with a phenol compound or phenyl ether compound; JP-A 61-72246, 62-208048, 62-157031 and 63-163351 disclose a technique of using an amine compound in combination. JP-A 63-24256 proposes a pyrazoloazole magenta coupler having an alkyloxyphenyloxy group. However, improvements in light fastness of magenta dye images through these techniques were proved to be insufficient and further improvements are strongly desired.

SUMMARY OF THE INVENTION

Accordingly, it is an object of the present invention to provide a silver halide color photographic light sensitive material superior in color forming property and improved in light fastness of magenta dye images.

The object of the present invention can be accomplished by a silver halide color photographic light sensitive material comprising a support having thereon photographic component layers including a blue-sensitive silver halide emulsion layer, green-sensitive silver halide emulsion layer and a red-sensitive silver halide emulsion layer, wherein said green-sensitive silver halide emulsion layer comprises a coupler represented by the following formula (M):

Formula (M)

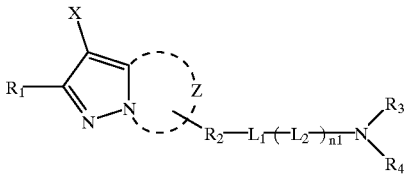

wherein $R_1$ represents a substituent; $R_2$ represent an alkylene group or arylene group; $R_3$ an alkyl group containing at least one hydroxy group; $R_4$ represents a hydrogen atom, alkyl group or alkyl group containing at least one hydroxy group, provided that a total number of the hydroxy group contained in $R_3$ and $R_4$ is 2 or 3; $L_1$ represents a bivalent linkage group selected from the group consisting of —O—, —S— and —CO—; $L_2$ represents a bivalent linkage group selected from the group consisting of —O—, —S—, —CO—, —$SO_2$—, —$NR_5$—, an alkylene group and arylene group, in which $R_5$ represents a hydrogen atom, alkyl group, aryl group, acyl group, sulfonyl group, alkoxycarbonyl group, aryloxycarbonyl group, carbamoyl group or sulfamoyl group; $n_1$ is an integer of 0 to 20, provided that when $n_1$ is 2 or more, plural $L_2$ may be the same or different from each other and an alkylene group is not directly linked to —$N(R_3)R_4$; X represents a hydrogen atom or a group capable of being released upon reaction with an oxidation product of a developing agent; and Z represents an atomic group necessary for forming a nitrogen-containing heterocyclic group.

DETAILED DESCRIPTION OF THE INVENTION

A magenta coupler represented by formula (M) according to the invention will be explained as below.

In the formula, $R_1$ represents a substituent. Examples of the substituent represented by $R_1$ includes an alkyl group (e.g., methyl, ethyl, propyl, isopropyl, tert-butyl, pentyl, cyclopentyl, hexyl, cyclohexyl, octyl, dodecyl), alkenyl group (e.g., vinyl, allyl), alkynyl group (e.g., propargyl), aryl group (e.g., phenyl, naphthyl), heterocyclic group (e.g., pyridyl, thiazolyl, oxazolyl, imidazolyl, furyl, pyrrolyl, pyrazinyl, pyrimidinyl, selenazolyl, sulfolanyl, piperidinyl, pyrazolyl, tetrazolyl), halogen atom (e.g., chlorine atom, bromine atom, iodine atom, fluorine atom), alkoxy group (e.g., methoxy, ethoxy, propyloxy, pentyloxy, cyclopentyloxy, hexyloxy, cyclohexyloxy, octyloxy, dodecyloxy), aryloxy group (e.g., phenoxy, naphthyloxy), alkoxycarbonyl group (e.g., methyloxycarbonyl, ethyloxycarbonyl, butyloxycarbonyl, octyloxycarbonyl, dodecyloxycarbonyl), aryloxycarbonyl group (e.g., phenyloxycarbonyl, naphthyloxycarbonyl), sulfonamido group (e.g., methylsulfonylamino, ethylsulfonylamino, butylsulfonylamino, hexylsulfonylamino, cyclohexylsulfonylamino, octylsulfonylamino, dodecylsulfonylamino, phenylsulfonylamino), sulfamoyl group (e.g., aminosulfonyl, methylaminosulfonyl, dimethylaminosulfonyl, butylaminosulfonyl, hexylaminosulfonyl, cyclohexylaminosulfonyl, octylaminosulfonyl, dodecyaminosulfonyl, phenylaminosulfonyl, naphthylaminosulfonyl, 2-pyridylaminosulfonyl), ureido group (e.g., methylureido, ethylureido, pentylureido, cyclohexylureido, octylureido, dodecylureido, phenylureido, naphthylureido, 2-pyridylaminoureido), acyl group (e.g., acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl), carbamoyl group (e.g., aminocarbonyl, methylaminocarbonyl, propylamino-carbonyl, dimethylaminocarbonyl, propylaminocarbonyl, pentylaminocarbonyl, cyclohexylaminocarbonyl, octylaminocarbonyl, 2-ethylhexylaminocarbonyl, dodecylaminocarbonyl, phenylaminocarbonyl, naphthylaminocarbonyl, 2-pyridylaminocarbonyl), amido group (e.g., methylcarbonylamino, ethylcarbonylamino, dimethylcarbonylamino, propylcarbonylamino, pentylcarbonylamino, cyclohexylcarbonylamino, 2-ethylhexylcarbonylamino, octylcarbonylamino, dodecylcarbonylamino, phenylcarbonylamino, naphthylcarbonylamino), sulfonyl group (e.g., methylsulfonyl, ethylsulfonyl, butylsulfonyl, cyclohexylsulfonyl, 2-ethylhexylsulfonyl, dodecylsulfonyl, phenylsulfonyl, naphthylsulfonyl, 2-pyridylsulfonyl), amino group (e.g., amino, ethylamino, dimethylamino, butylamino, cyclopentylamino, 2-ethylkhexylamino, dodecylamino, anilino, naphtylamino, 2-pyridylamino), cyano group, nitro group, sulfo group, carboxyl group, and hydroxyl group. These groups may be substituted by the substituent described above. Of these groups are preferred the alkyl group, cycloalkyl group, alkenyl group, aryl group, acylamino group, sulfonamido group, alkylthio group, arylthio group, halogen atom, heterocyclic group, sulfonyl group, sulfinyl group, phosphonyl group, acyl group, carbamoyl group, sulfamoyl group, cyano group, alkoxy group, aryloxy group, heterocyclic oxy group, siloxy group, acyloxy group, carbamoyloxy group, amino group, alkylamino group, imido group, ureido group, sulfamoylamino group, alkoxycarbonylamino group, aryloxycarbonylamino group, alkoxycarbonyl, aryloxycarbonyl and carboxyl; an alkyl group is more preferred and t-butyl group is furthermore preferred.

In the formula, $R_2$ represents an alkylene group or arylene group. Examples of the alkylene group represented by $R_2$ include methylene, ethylene, propylene and butylene. The arylene group represented by $R_2$ includes, for example, phenylene and naphthylene. Of these is preferred the alkylene group. The alkylene group and arylene group represented by $R_2$ may each have a substituent. As the substituent is cited the same one as described in $R_1$.

Exemplary examples of an alkylene group and arylene group represented by $R_2$ are shown as below, but $R_2$ is not limited thereto.

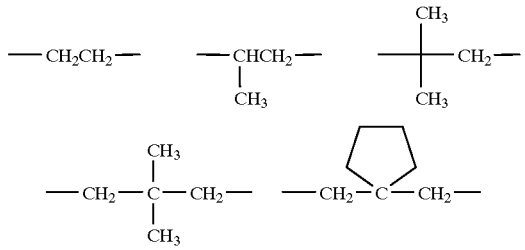

-continued

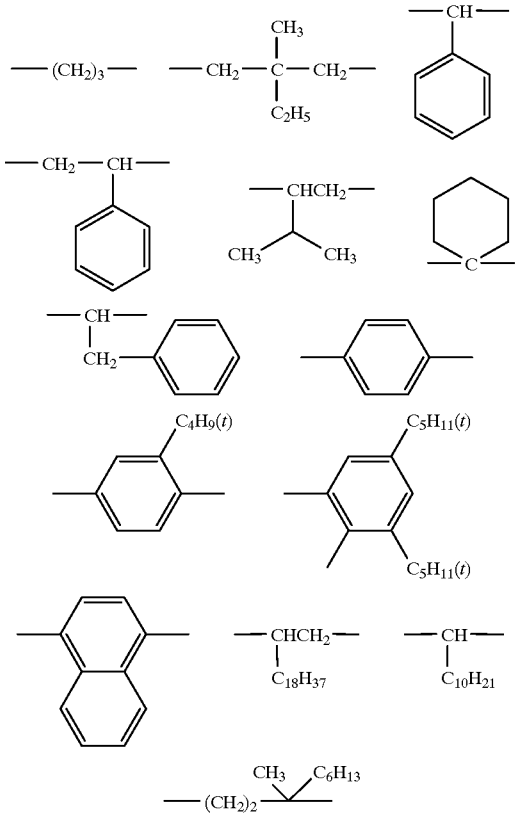

$R_2$ is preferably an alkylene group.

$R_3$ represents an alkyl group containing a hydroxy group, including, e.g., hydroxymethyl, 2-hydroxyethyl, 1,2-dihydroxyethyl, 2-hydroxy-n-propyl, 3-hydroxy-n-propyl and 2,3-dihydroxy-n-propyl.

$R_4$ represents a hydrogen atom, an alkyl group or alkyl group containing a hydroxyl group. The alkyl group represented by $R_4$ includes, e.g., methyl, ethyl, propyl, iso-propyl, t-butyl, pentyl, cyclopentyl, hexyl, cyclohexyl, octyl and dodecyl. The alkyl group containing a hydroxyl group, represented by $R_4$ includes, e.g., hydroxymethyl, 2-hydroxyethyl, 1,2-dihydroxyethyl, 2-hydroxy-n-propyl, 3-hydroxy-n-propyl and 2,3-dihydroxy-n-propyl. The total number of the hydroxy group contained in $R_3$ and $R_4$ is 2 or 3.

$L_1$ is a bivalent linking group selected from —O—, —S—, and —CO—. Of these linking group are preferred —O— and —CO—. $L_2$ is a bivalent linking group selected from —O—, —S—, —CO—, —$SO_2$—, —$NR_5$—, alkylene group and arylene group, in which $R_5$ represents a hydrogen atom, alkyl group, aryl group, acyl group, sulfonyl group, alkoxycarbonyl group, aryloxycarbonyl group, carbamoyl group, or sulfamoyl group. The alkyl group represented by $R_5$ includes methyl, ethyl, propyl, isopropyl, t-butyl, pentyl, cyclopentyl, hexyl, cyclohexyl, octyl and dodecyl. The aryl group represented by $R_5$ includes a phenyl group and naphthyl group. The acyl group represented by $R_5$ includes acetyl, ethylcarbonyl, propylcarbonyl, pentylcarbonyl, cyclohexylcarbonyl, octylcarbonyl, 2-ethyl-hexylcarbonyl, dodecylcarbonyl, phenylcarbonyl, naphthylcarbonyl and pyridylcarbonyl. The sulfonyl group represented by $R_5$ includes methylsulfonyl, ethylsulfonyl, butylsulfonyl, cyclohexylsulfonyl, 2-ethylhexylsulfonyl, dodecylsulfonyl, phenylsulfonyl, naphthylsulfonyl, and 2-pyridylsulfonyl. The alkoxycarbonyl group represented by $R_5$ includes methyloxycarbonyl, ethyloxycarbonyl, butyloxycarbonyl, octyloxycarbonyl and dodecyloxycarbonyl. The aryloxycarbonyl group represented by $R_5$ includes phenyloxycarbonyl and naphthyloxycarbonyl.

The carbamoyl group represented by $R_5$ includes aminocarbonyl, methylaminocarbonyl, dimethylaminocarbonyl, propylaminocarbonyl, pentylaminocarbonyl, cyclohexylaminocarbonyl, octylamino-carbonyl, 2-ethylhexylaminocarbonyl, octylaminocarbonyl, 2-ethylhexylaminocarbonyl, dodecyaminocarbonyl, phenylaminocarbonyl, naphthylaminocarbonyl and 2-pyridylaminocarbonyl. The sulfamoyl group represented by $R_5$ includes aminosulfonyl, methylaminosulfonyl, dimethylamino-sulfonyl, butylaminosulfonyl, hexylaminosulfonyl, cyclohexylaminosulfonyl, octylaminosulfonyl, dodecylaminosulfonyl, phenylaminosulfonyl, and 2-pyridylamino-sulfonyl. The alkyl group, aryl group, acyl group, sulfonyl group, alkoxycarbonyl group, aryloxycarbonyl group, carbamoyl group and sulfamoyl group represented by $R_5$ each may have a substituent, and the substituent is the same as described in $R_1$.

The alkylene group represented by $L_2$ is the same as defined in $R_2$, including methylene, ethylene, propylene and butylene. The arylene group represented by $L_2$ is the same as defined in $R_2$, including phenylene and naphthylene.

In formula (M), n1 is an integer of 0 to 20. When n1 is 2 or more, plural $L_2$s may be the same or different from each other, and the alkylene group is not directly linked to —$NR_3(R_4)$. n1 is preferably an integer of 0 to 10.

In the formula, X represents a hydrogen atom or a coupling-off group, which is capable of being released upon reaction with an oxidation product of a developing agent. Examples the coupling-off group include a halogen atom (e.g., chlorine atom, bromine atom, fluorine atom), alkoxy, aryloxy, heterocyclic-oxy, acyloxy, sulfonyloxy, alkoxycarbonyloxy, aryloxycarbonyloxy, alkyloxalyloxy, alkoxyoxalyloxy, alkylthio, arylthio, heterocyclic-thio, alkyloxythiocarbonylthio, acylamino, sulfonamido, N atom-bonded nitrogen containing heterocyclic ring, alkyloxycarbonylamino, aryloxycarbonylamino and carboxyl. Of these are preferred halogen atoms, more preferably, a chlorine atom.

In the formula, Z represents a group of atoms necessary for forming a nitrogen-containing heterocyclic ring. The heterocyclic rings formed by Z include a pyrazole ring, imidazole ring, triazole ring, tetrazole ring. Of these, preferred skeletons are represented by the following (I), (II) and (III), more preferably, (I):

[I]

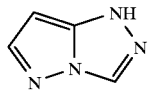

[II]

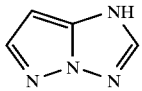

[III]

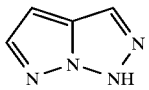

In the formula, it is preferred that hydroxy groups are not contained in a site other than $R_3$ and $R_4$.

Exemplary examples of the magenta coupler represented by formula (M) are shown below, but the invention is not limited to these examples.

M-1

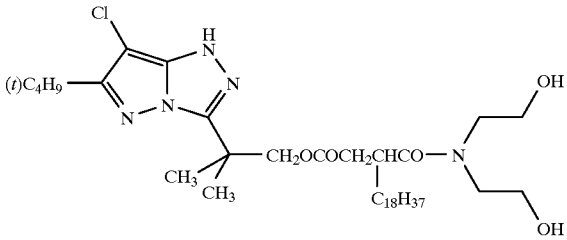

M-2

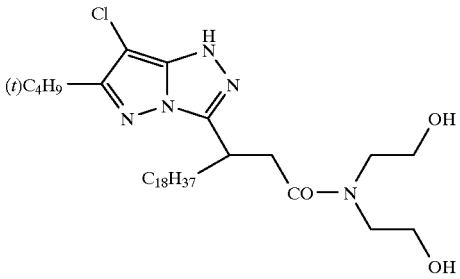

-continued
M-3
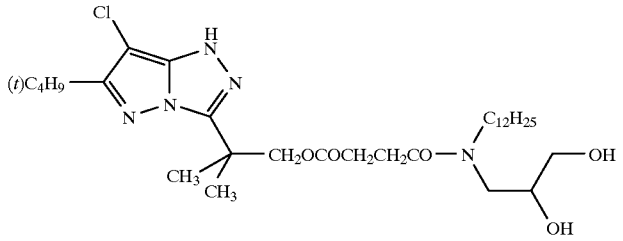
M-4
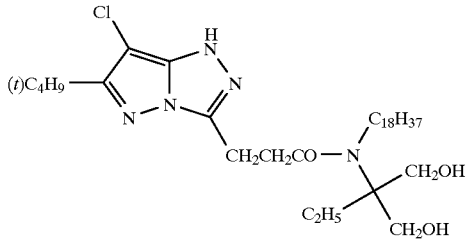
M-5
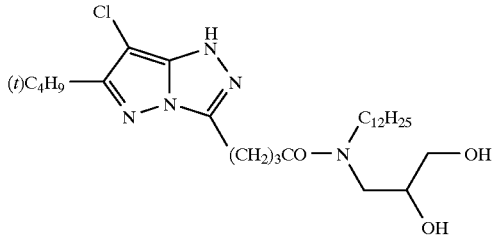
M-6
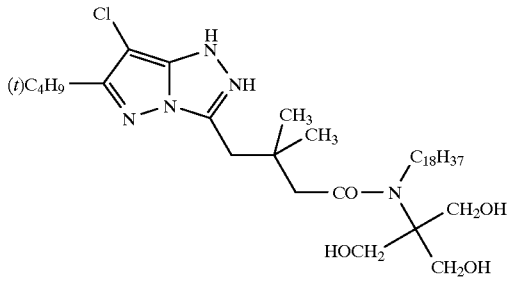
M-7
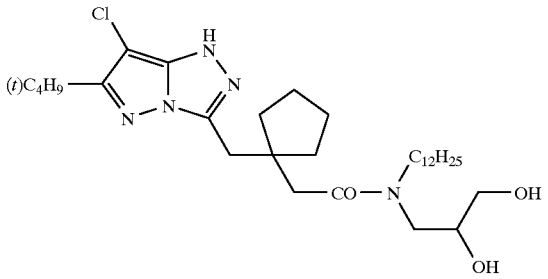

-continued
M-8
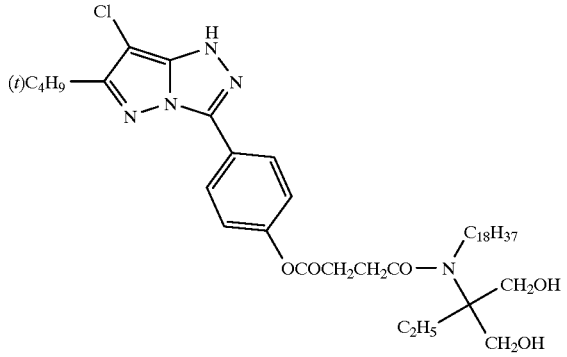
M-9
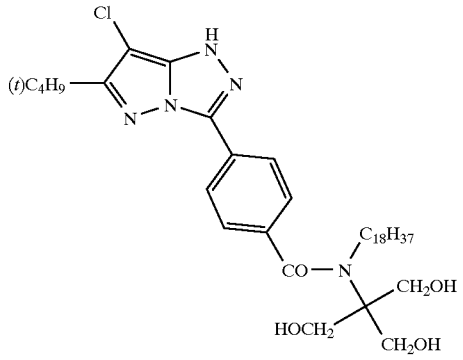
M-10
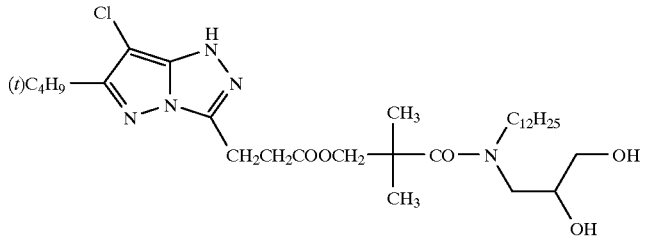
M-11
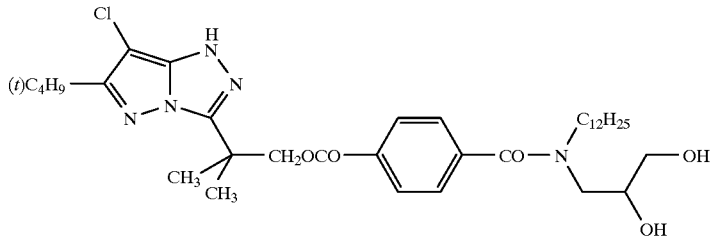
M-12
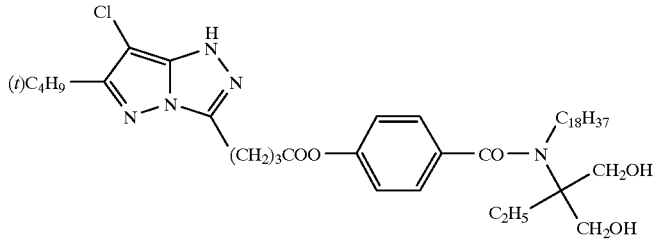

-continued
M-13
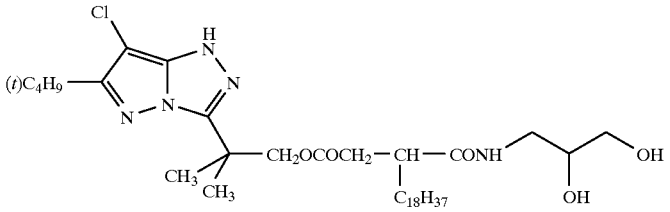
M-14
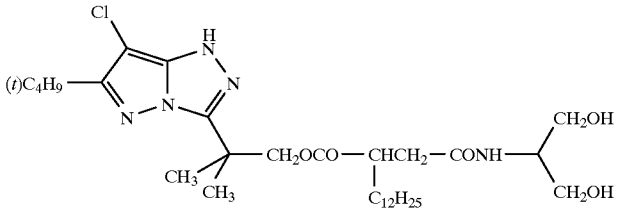
M-15
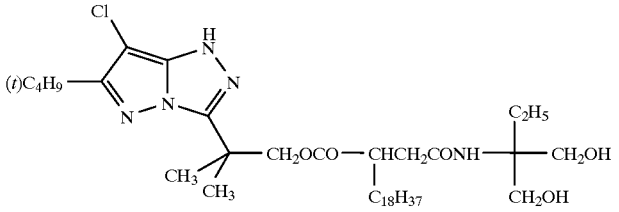
M-16
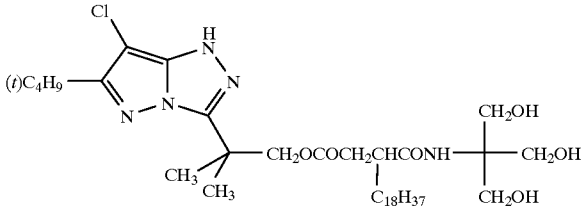
M-17
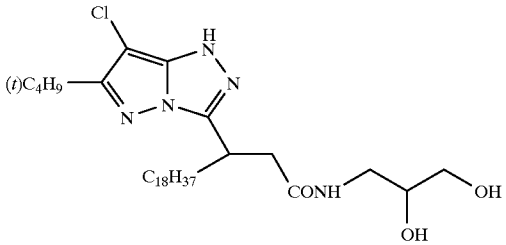
M-18
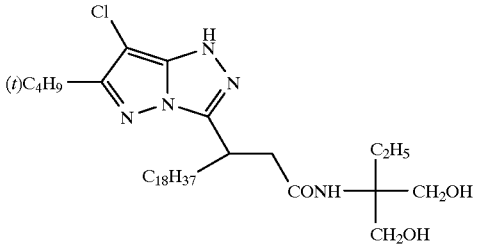

-continued
M-19
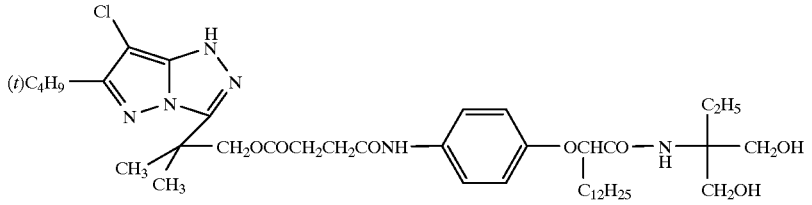
M-20
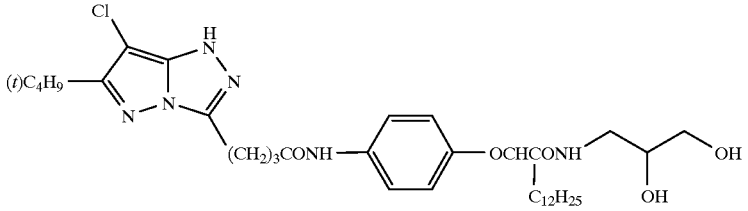
M-21
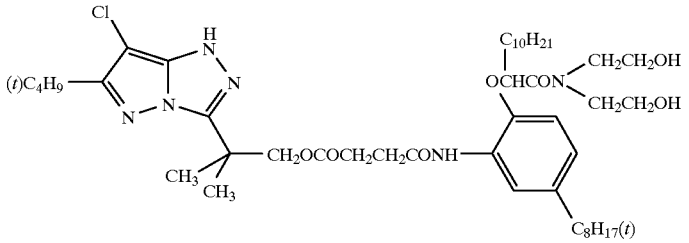
M-22
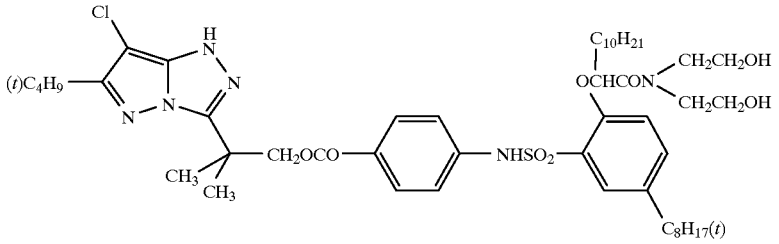
M-23
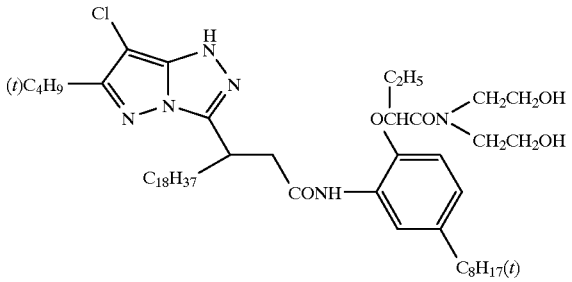
M-24
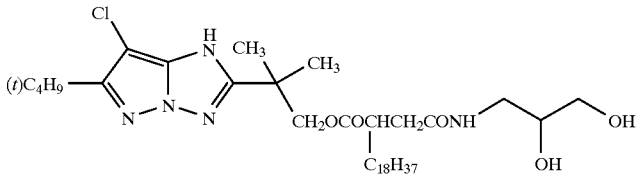

-continued

M-25

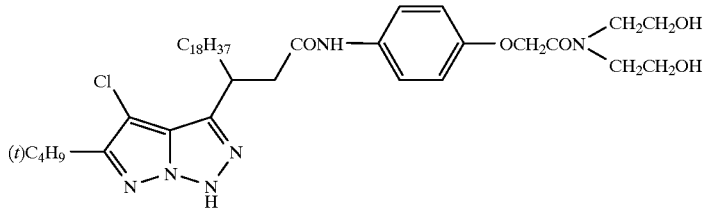

M-26

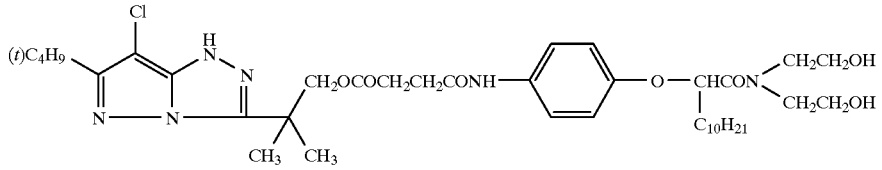

M-27

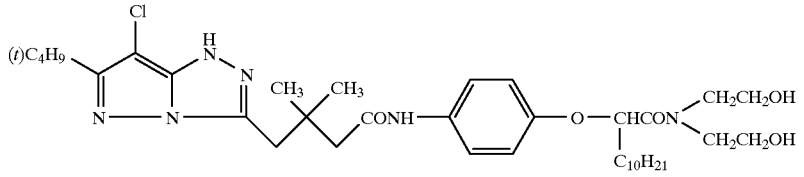

M-28

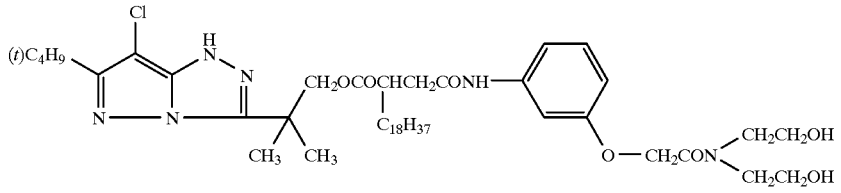

M-29

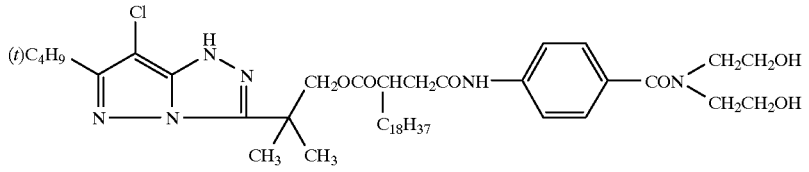

M-30

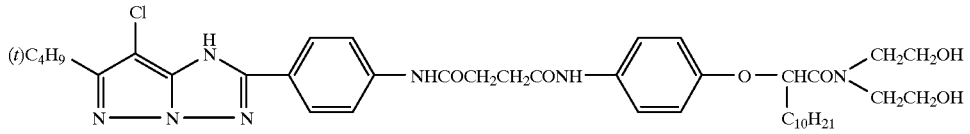

Pyrazoloazole magenta couplers according to the invention can be readily synthesized, with reference to Journal of Chemical Society, Perkin I (1977), 2047–2052; U.S. Pat. No. 3,725,067; JP-A 59-99437, 58-42045, 59-162548, 59-171956, 60-33552, 60-43659, 60-172982, 60-190779, 61-189539, 61-241754, 63-163351, 62-157031; Syntheses, 1981 page 40, ibid 1984, page 122, ibid 1984, page 894; JP-A 49-53574; British patent 1,410,846; Shin Jikken Kagaku Kohza (New Series of rimental Chemistry) Vol. 14-III, pages 1585–1594 (1977), published by Maruzen; Helv. Chem. Acta., 36, 75 (1953); J. Am. Chem. Soc., 72, 2726 (1950); and Org. Synth., Vol. II, page 395 (1943).

Synthesis of the magenta coupler according to the invention is exemplarily shown as below.

Synthesis of Compound M-1:

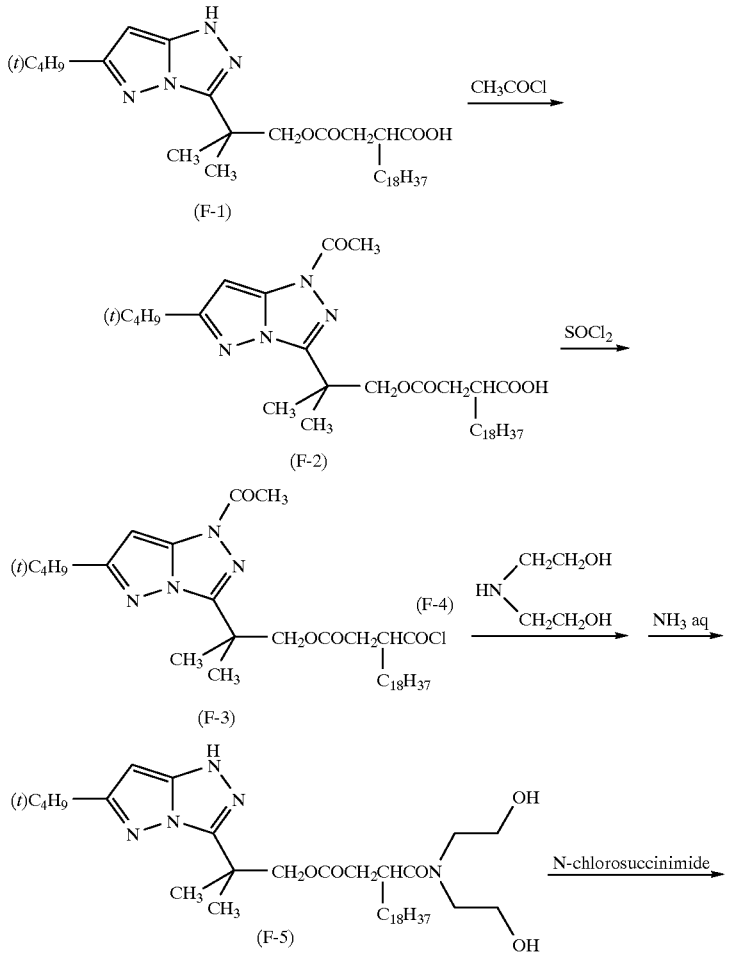

Exemplified compound M-1

Compound (F-1) of 4.75 g was dissolved in a mixed solvent of acetonitrile of 20 ml and tetrahydrofuran of 10 ml and a reaction vessel was cooled by a ice-water bath. Further thereto was added 1.96 ml of pyridine and then 0.95 ml of acetyl chloride was gradually added dropwise. After completing addition, the reaction vessel was taken out of the ice-water bath and allowed to be stirred at room temperature. After the reaction mixture was concentrated, 30 ml of ethyl acetate was added thereto to dissolve the residue and the resulting solution was washed with diluted hydrochloric acid and then with water , followed by concentrating the solution to obtain a compound (F-2).

To the resulting compound (F-2) were added 30 ml of chloroform and 1.8 ml of thionyl chloride and the solution was stirred at 50° C. for a period of 4 hr., followed by concentration to obtain a compound (F-3). Subsequently, 1.70 g of a compound (F-4) was dissolved in a mixed solvent of 12 ml of acetonitrile and 3 ml of acetoamide and a solution of the compound (F-3) which was dissolved in 5 ml of acetonitrile and 10 ml of tetrahydrofuran was added thereto for a period of 30 min. and stirred at room temperature for 1 hr. Then, 4 ml of 29% ammonia water was added thereto and stirred at room temperature for 2 hr., followed by washing with water to obtain a compound (F-5). The resulting compound (F-5) was dissolved in 40 ml of ethyl acetate and was added 0.90 g of N-chlorosuccinimide, followed by stirring at room temperature for 2 hr. After completion of the reaction, the reaction mixture was washed with water and concentrated. The resulting residue was refined by column chromatography (silica gel, developing solvent: ethyl acetate/n-hexane) to obtain a white solid compound (4-1) of 3.65 g (m.p.; 79–80° C.). The compound (M-1) was identified by mass spectrum and NMR spectrum.

According to the invention, the magenta coupler represented by formula (M) can be employed in combination with an image stabilizer represented by formulas (A) and/or (B).

Formula (A)

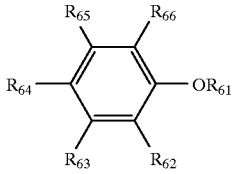

In the formula, $R_{61}$ represents a hydrogen atom, an alkyl group, alkenyl group, aryl group, or heterocyclic group. Examples of the alkyl group include straight chained or branched one such as methyl, ethyl, propyl, octyl, t-octyl, benzyl or hexadecyl. Examples of the alkenyl represented by $R_{61}$ include allyl, hexenyl and octenyl. Examples of the aryl group include phenyl and naphthyl. Examples of the heterocyclic group include tetrahydropyranyl and pyrimidinyl. These groups represented by $R_{61}$ may each have a substituent. $R_{62}$, $R_{63}$, $R_{65}$ and $R_{66}$ each represent a hydrogen atom, halogen atom, hydroxy group, alkyl group, alkenyl group, aryl group, alkoxy group, or acylamino group. Of these, the alkyl group, alkenyl group and aryl group each are the same as those defined in $R_{61}$. Examples of the halogen atom include fluorine, chlorine and bromine. Examples of the alkoxy group include methoxy, ethoxy, and benzyloxy. The acylamino group is represented by $R_{67}CONH$—, in which $R_{67}$ is an alkyl group (e.g., methyl, ethyl, propyl, octyl, t-octyl, benzyl), alkenyl group (e.g., allyl, octenyl, oleyl), aryl group (e.g., phenyl, methoxyphenyl, naphthyl) or heterocyclic group (e.g., pyridyl, pyrimidyl). $R_{64}$ represents an alkyl group, hydroxy group, aryl group, alkoxy group, alkenyloxy group, or aryloxy group. Of these, the alkyl group and aryl group are the same as those defined in $R_{61}$. The alkoxy groups are the same as those cited in $R_{62}$, $R_{63}$, $R_{65}$ and $R_{66}$. $R_{61}$ and $R_{62}$ may combine with each other to form a 5 or 6-membered ring; and $R_{63}$ and $R_{64}$ may combine with each other to form a 5-membered ring. These rings includes one which is linked to another ring through spirobonding.

Exemplary examples of the compound represented by formula (A) are shown below, but the invention is not limited thereto.

A-1

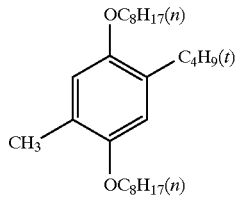

A-2

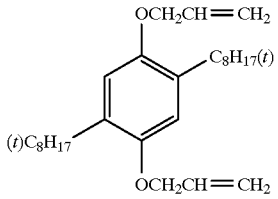

A-3

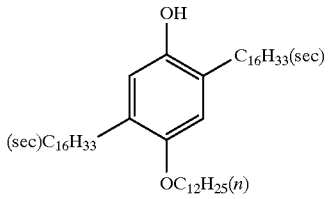

-continued

A-4

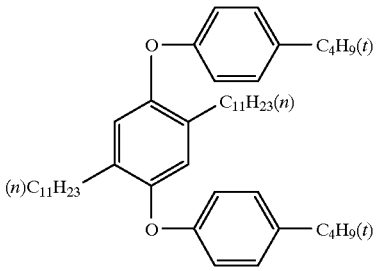

A-5

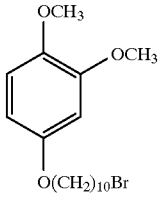

A-6

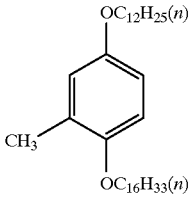

A-7

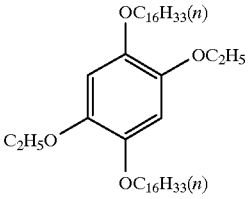

A-8

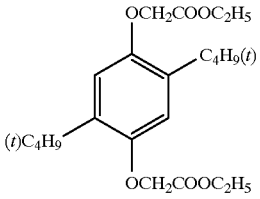

A-9

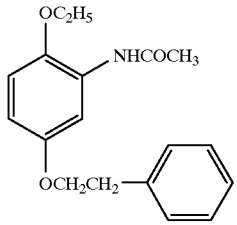

A-10

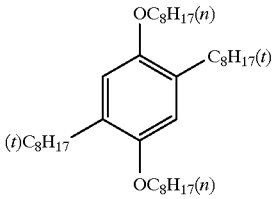

-continued
A-11
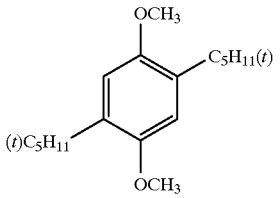
A-12
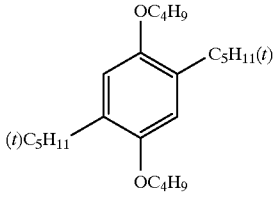
A-13
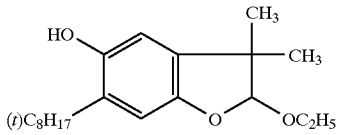
A-14
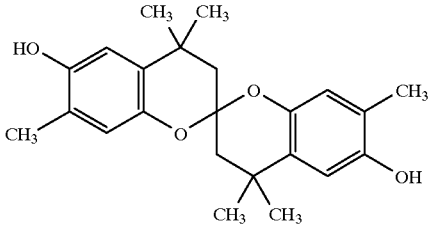
A-15
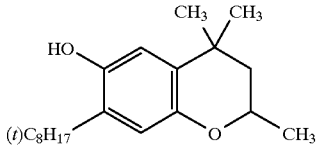
A-16
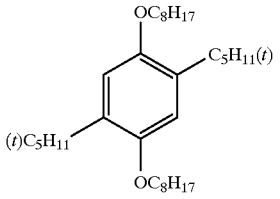
A-17
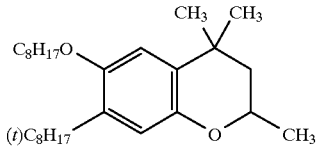
A-18
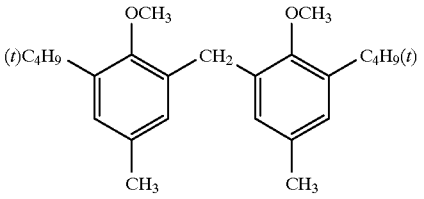
-continued
A-19
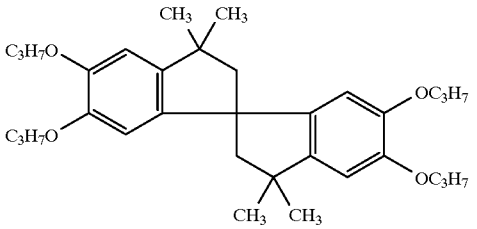
A-20
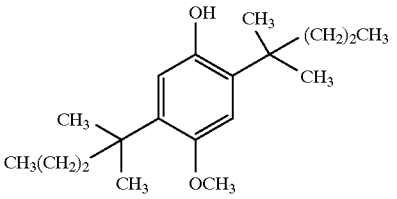
A-21
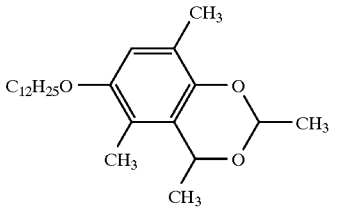
A-22
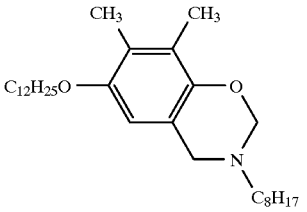
A-23
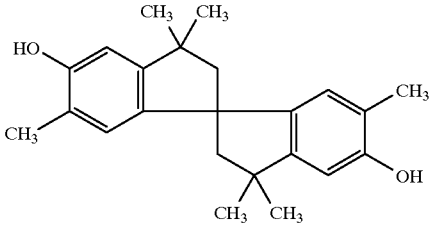
A-24
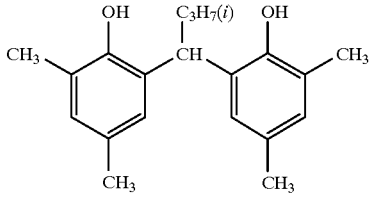
The compounds represented by formula (A) can be readily synthesized according to methods described in Journal of the Chemical Society, 415–417 (1962) and ibid 2904–2914 (1965); The Journal of Organic Chemistry, vol. 23, 75–76; Tetrahedron, vol. 26, 4743–4751 (1970); Chem. Lett., (4), 315–316 (1972); Nihon Kagakukaishi No.10, 1987–1990 (1972); Bulletin of Chemical Society of Japan vol. 53, 555–556 (1980).

Formula (B)

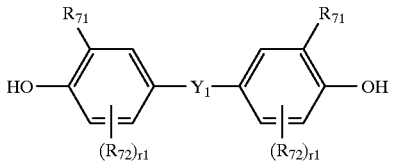

In the formula $R_{71}$ represents a secondary or tertiary alkyl group, secondary or tertiary alkenyl group, cycloalkyl group or aryl group; $R_{72}$ represents a halogen atom, alkyl group, alkenyl group, cycloalkyl group or aryl group; r1 is an integer of 0 to 3 and when two or more of each of $R_{71}$ and $R_{72}$ are present in the molecule, each of $R_{71}$ and $R_{72}$ may be the same or different from each other; $Y_1$ represents —S—, —SO—, —$SO_2$— or an alkylene group.

The secondary or tertiary alkyl group or secondary or tertiary alkenyl group represented by $R_{72}$ are preferably those having 3 to 32 carbon atoms and more preferably, 4 to 12 carbon atoms. Examples thereof include t-butyl, t-amyl, sec-amyl, t-octyl, i-propyl, i-propenyl and 2-hexenyl. The alkyl group represented by $R_{72}$ is preferably one having 2 to 32 carbon atoms, which may be straight-chained or branched. Examples thereof include methyl, ethyl, t-butyl, pentadecyl, 1-hexylnonyl, 2-chlorobutyl, benzyl, 2,4-di-t-amylphenoxymethyl, 1-ethoxytridecyl, ally, and isopropenyl. The cyclohexyl group represented by $R_{71}$ and $R_{72}$ is preferably one having 3 to 12 carbon atoms, such as cyclohexyl, 1-methylcyclohexyl or cyclopentyl. The aryl group represented by $R_{71}$ and $R_{72}$ is preferably a phenyl group or naphthyl group, such as phenyl, 4-nitrophenyl, 4-t-butylphenyl, 2,4-di-t-amylphenyl, 3-hexadecyloxyphenyl, or α-naphthyl. The alkylene group represented by $Y_1$ is preferably one having 1 to 12 carbon atoms. Examples thereof include methylene, ethylene, propylene, butylene and hexamethylene. The groups represented by $R_{71}$, $R_{72}$ and $Y_1$ each may have a substituent. Examples of the substituent include a halogen atom, nitro, cyano, amido, sulfonamido, alkoxy, aryloxy, alkylthio, arylthio and acyl.

Exemplary examples of the compound represented by formula (B) are shown below, but the present invention is not limited thereto.

B-1

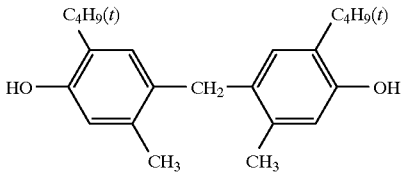

B-2

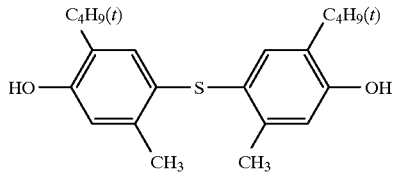

-continued

B-3

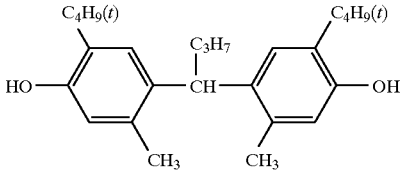

B-4

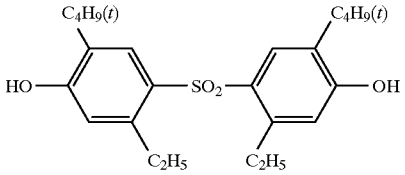

B-5

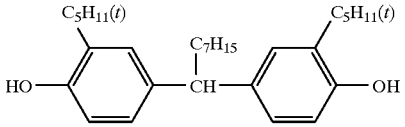

B-6

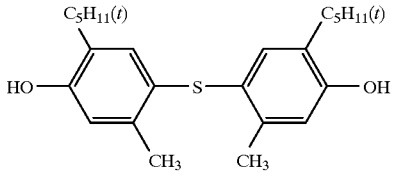

B-7

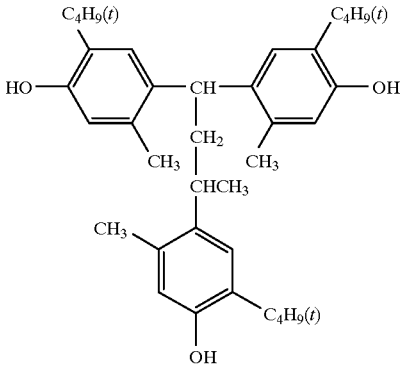

B-8

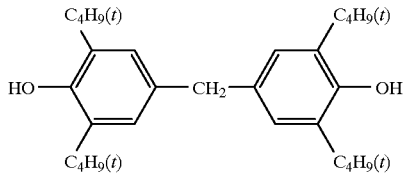

B-9

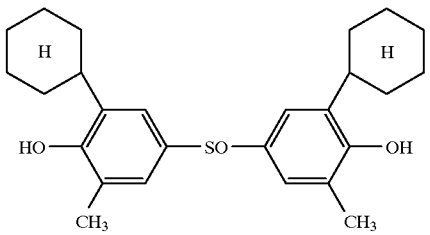

-continued

B-10

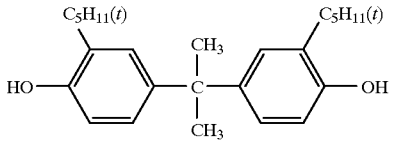

B-11

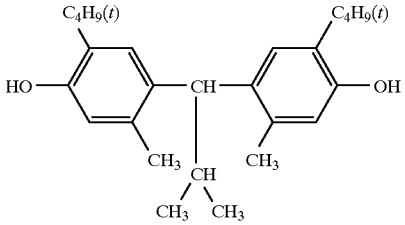

B-12

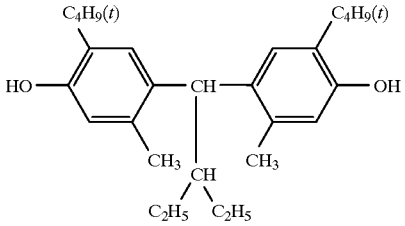

The compounds represented by formula (B) can be readily synthesized in accordance with methods described in U.S. Pat. No. 2,807,653 and J. Chem. Soc. Perkin I, 1712 (1979).

The image stabilizer represented by formula (A) or (B) is preferably used in an amount of 5 to 400 mol % and more preferably, 10 to 250 mol %, based on the magenta coupler represented by formula (M) according to the invention. The magenta coupler and the image stabilizer are preferably contained together in the same layer, but the image stabilizer may be contained in a layer adjacent to a coupler containing layer.

The magenta coupler represented by formula (M) may be contained in an amount of $1\times10^{-3}$ to $8\times10^{-1}$, preferably, $1\times10^{-2}$ to $8\times10^{-1}$ per mol of silver halide. The magenta coupler can be used in combination with another kind of coupler. The magenta coupler used according to the invention is incorporated in such a manner that the coupler is, singly or in combination, dissolved in a mixture of a high boiling solvent such as dibutyl phthalate or tricresyl phosphate and a low boiling solvent such as butyl acetate or ethyl acetate or in the low boiling solvent alone, the resulting solution is mixed with an aqueous gelatin solution containing a surfactant and dispersed to be emulsified by using a high-speed rotating mixer, colloid mil or ultrasonic homogenizer, and the emulsion is directly incorporated into a silver halide emulsion. The emulsified dispersion can be set, and then shredded and washed with water, thereafter, added into a silver halide emulsion. Magenta couplers according to the invention each can be dispersed in a high boiling solvent and separately added into a silver halide emulsion, but the magenta couplers preferably are together dissolved and simultaneously dispersed, and then added into a silver halide emulsion. The high boiling solvent is employed in an amount of 0.01 10 and preferably 0.1 to 3.0 g/g of magenta coupler.

As a silver halide emulsion usable in a photographic material according to the invention. any of conventionally used silver halide emulsions can be optionally used. The silver halide emulsion can be chemically sensitized in accordance with the conventional manner, and spectrally sensitized with a sensitizing dye to a desired wavelength region.

To the silver halide emulsion can be incorporated an adjuvant such as antifoggant or stabilizer. Gelatin can advantageously be employed as a binder for the emulsion. A silver halide emulsion layer and another hydrophilic colloid layer can be hardened. A plasticizer or a dispersion of a water insoluble or water sparingly soluble synthetic polymer (i.e., latex) can be incorporated. In a silver halide emulsion layer of a color photographic material, a coupler is employed. Further, there can be incorporated a colored coupler having color correction effects, competing coupler and a compound capable of releasing, upon coupling reaction with an oxidation product of a developing agent, a photographically useful fragment, such as a development accelerator, bleach accelerator, developing agent, silver halide solvent, toning agent, hardener, fogging agent, antifogging agent, chemical sensitizer, spectral sensitizer or desensitizer. Furthermore, an image stabilizer or UV absorbent can be incorporated to prevent deterioration of color images.

Paper laminated with polyethylene, polyethylene terephthalate film, baryta paper or cellulose triacetate film can be employed as a support.

To obtain color dye image using the photographic material according to the invention, the photographic material, after exposure, can be subjected to color processing.

EXAMPLES

The present invention is explained based on examples, but embodiments of the present invention are not limited to these examples.

Example 1

On a paper support laminated with polyethylene on one side thereof and with polyethylene containing titanium oxide on the other side thereof, each of the layers having the following compositions was coated on the titanium oxide-containing polyethylene layer-side, so that Sample 101 of a multilayered silver halide photographic light-sensitive material was prepared. The coating solutions were prepared in the following manner.

TABLE 1

| Layer | Composition | Amount ($g/m^2$) |
|---|---|---|
| Layer 7 (Protective layer) | Gelatin | 1.00 |
| Layer 6 (UV-absorption layer) | Gelatin | 0.40 |
| | UV-absorbent (UV-1) | 0.10 |
| | UV-absorbent (UV-2) | 0.04 |
| | UV-absorbent (UV-3) | 0.16 |
| | Antistaining agent (HQ-1) | 0.01 |
| | DNP | 0.20 |
| | PVP | 0.03 |
| | Anti-irradiation dye (AIC-1) | 0.02 |
| Layer 5 (Red-sensitive layer) | Gelatin | 1.30 |
| | Red-sensitive silver chlorobromide emulsion (Em-R) | 0.21 |
| | Cyan coupler (EC-1) | 0.24 |
| | Cyan coupler (EC-2) | 0.08 |
| | Dye-image stabilizer (ST-1) | 0.20 |
| | Antistaining agent (HQ-1) | 0.01 |
| | HBS-1 | 0.20 |
| | DOP | 0.20 |
| Layer 4 | Gelatin | 0.94 |

TABLE 1-continued

| Layer | Composition | Amount ($g/m^2$) |
|---|---|---|
| (UV-absorption layer) | UV-absorbent (UV-1) | 0.28 |
| | UV-absorbent (UV-2) | 0.09 |
| | UV-absorbent (UV-3) | 0.38 |
| | Antistaining agent (HQ-1) | 0.03 |
| | DNP | 0.40 |
| Layer 3 (Green-sensitive layer) | Gelatin | 1.40 |
| | Green-sensitive silver chlorobromide emulsion (Em-G) | 0.17 |
| | Magenta coupler (EM-1) | 0.75* |
| | DNP | 0.20 |
| | Dye-image stabilizer (ST-3) | 0.75* |
| | Dye-image stabilizer (B-3) | 0.75* |
| | Anti-irradiation dye (AIM-1) | 0.01 |
| Layer 2 (Intermediate layer) | Gelatin | 1.20 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.06 |
| | Antimold (F-1) | 0.002 |
| Layer 1 (Blue-sensitive layer) | Gelatin | 1.20 |
| | Blue-sensitive silver chlorobromide emulsion (Em-B) | 0.26 |
| | Yellow coupler (EY-1) | 0.80 |
| | Dye-image stabilizer (ST-1) | 0.30 |
| | Dye-image stabilizer (ST-2) | 0.20 |
| | Antistaining agent (HQ-1) | 0.02 |
| | Anti-irradiation dye (AIY-1) | 0.01 |
| | DNP | 0.20 |
| Support | Polyethylene-laminated paper | |

*$mmol/m^2$

The coated amounts of silver halide emulsions were indicated as calculated in terms of silver.

The coating solutions were prepared in the following manner.

Coating solution for Layer 1

Sixty (60) ml of ethyl acetate was added to 26.7 g of yellow coupler (Y-1), 10.0 g of dye-image stabilizer (ST-1), 6.67 g of dye-image stabilizer (ST-2), 0.67 g of antistaining agent (HQ-1), 6.67 g of high-boiling organic solvent (DNP) and 60 cc of ethyl acetate, and the mixture thereof was dissolved. The resulting solution was emulsified and dispersed in 220 ml of an aqueous 10% gelatin solution containing 7.0 ml of 20% surfactant (SU-1) by making use of an ultrasonic homogenizer, so that a yellow coupler dispersed solution could be prepared. The resulting dispersed solution was mixed with a blue light-sensitive silver halide emulsion (containing 8.67 g of silver) and an anti-irradiation dye (AIY-1) was further added thereto, so that a coating solution for Layer 1 could be prepared.

Coating solutions for Layers 2 through 7 were each prepared in a manner similar to the above-mentioned coating solution for Layer 1. As a hardener, (HH-1) was added to each of Layers 2 and 4 and (HH-2) to Layer 7. As a coating aid, surfactants (SU-1) and (SU-3) were added thereto, so that the surface tension of the layers were controlled.

Compounds used in the afore-mentioned layers are shown below.

EY-1

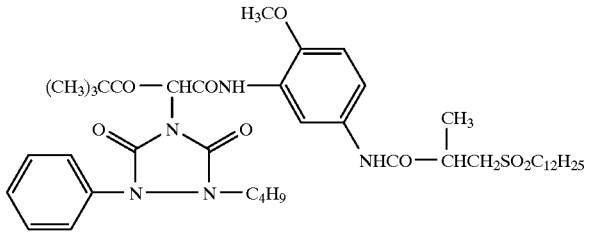

EC-1

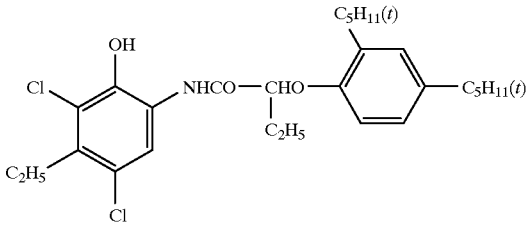

EC-2

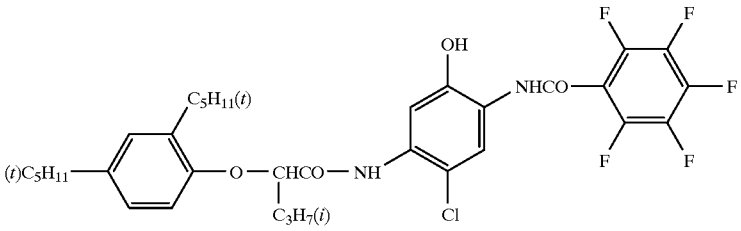

-continued
ST-1
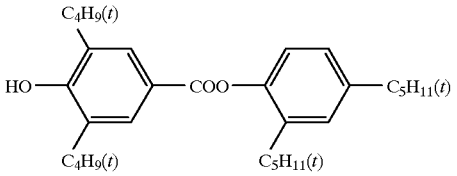
ST-2
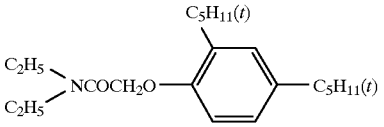
ST-3
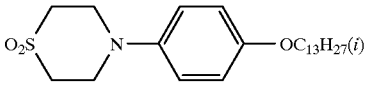
EM-1 (Comparative coupler)
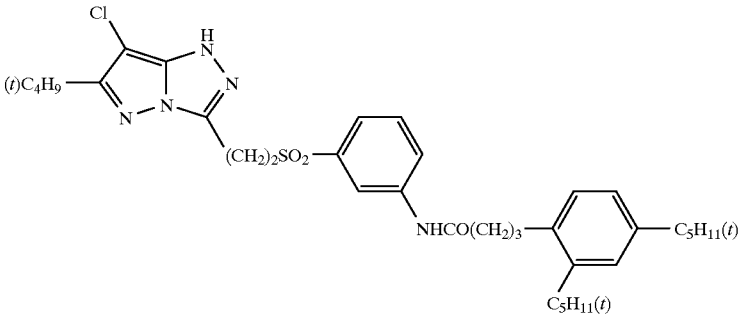
EM-2 (Comparative coupler)
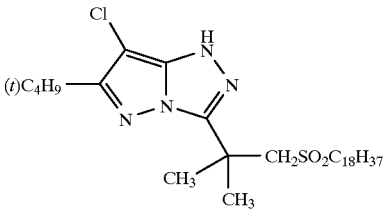
UV-1
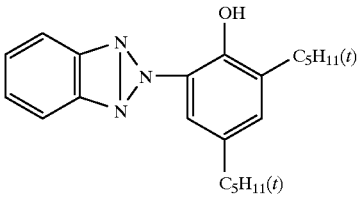
UV-2
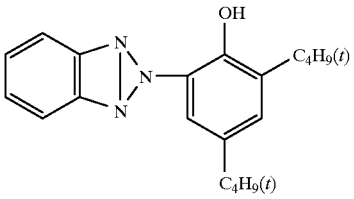

-continued
UV-3
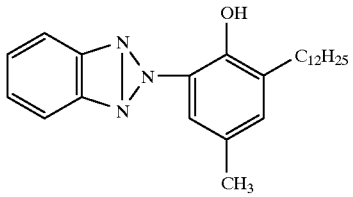
DOP Dioctyl phthalate
DNP Dinonyl phthalate
DIDP Diisodecyl phthalate
PVP Polyvinyl pyrrolidone
HQ-1
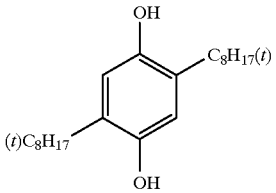
HQ-2
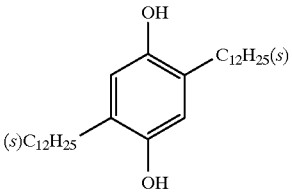
HQ-3
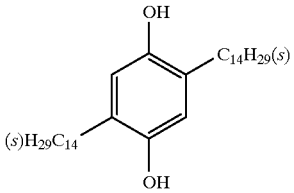
HQ-4
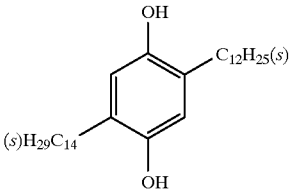
HQ-5
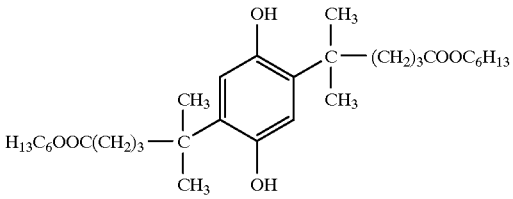
HBS-1
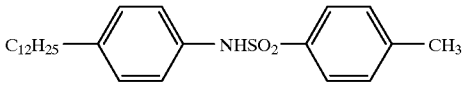
AIM-1
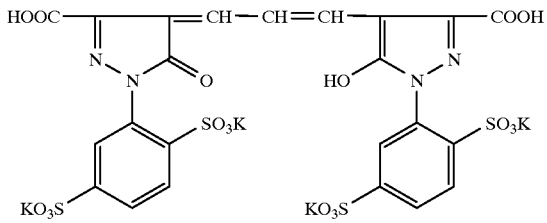
AIC-1
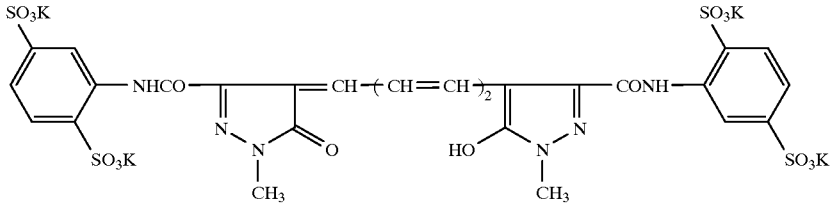

-continued

AIY-1

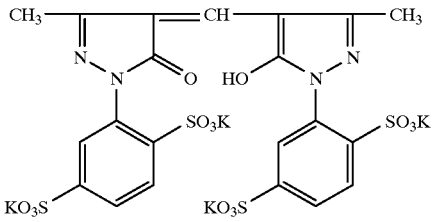

SU-1

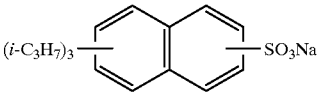

SU-2

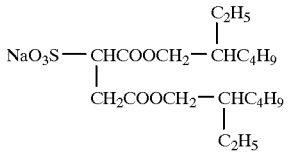

SU-3

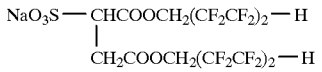

HH-1

HH-2

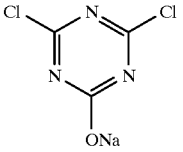

F-1

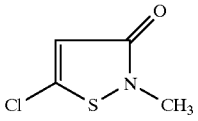

Silver halide emulsions used in Layers 1, 3 and 5 are as follows.

Blue-sensitive silver halide emulsion (Em-B):

A monodispersed silver bromochloride cubic grain emulsion having an average grain size of 0.85 $\mu$m, variation coefficient of grain size of 0.07 and chloride content of 99.5 mol % was chemically ripened by making use of the following compounds, so that a blue-sensitive silver halide emulsion (Em-B) was obtained.

| | |
|---|---|
| Sodium thiosulfate | 0.8 mg/mol of AgX |
| Chloroauric acid | 0.5 mg/mol of AgX |
| Stabilizer STAB-1 | $6 \times 10^{-4}$ mols/mol of AgX |
| Sensitizing dye BS-1 | $4 \times 10^{-4}$ mols/mol of AgX |
| Sensitizing dye BS-2 | $1 \times 10^{-4}$ mols/mol of AgX |

Green-sensitive silver halide emulsion (Em-G):

A monodispersed silver bromochloride cubic grain emulsion having an average grain size of 0.43 $\mu$m, variation coefficient of grain size of 0.08 and chloride content of 99.5 mol % was chemically ripened by making use of the following compounds, so that a blue-sensitive silver halide emulsion (Em-G) was obtained.

| | |
|---|---|
| Sodium thiosulfate | 1.5 mg/mol of AgX |
| Chloroauric acid | 1.0 mg/mol of AgX |
| Stabilizer STAB-1 | $6 \times 10^{-4}$ mols/mol of AgX |
| Sensitizing dye GS-1 | $4 \times 10^{-4}$ mols/mol of AgX |

Red-sensitive silver halide emulsion (Em-R)

A monodispersed silver bromochloride cubic grain emulsion having an average grain size of 0.50 $\mu$m, variation coefficient of grain size of 0.08 and chloride content of 99.5 mol % was chemically ripened by making use of the following compounds, so that a blue-sensitive silver halide emulsion (Em-R) was obtained.

| | |
|---|---|
| Sodium thiosulfate | 1.8 mg/mol of AgX |
| Chloroauric acid | 2.0 mg/mol of AgX |
| Stabilizer STAB-1 | $6 \times 10^{-4}$ mols/mol of AgX |
| Sensitizing dye RS-1 | $1 \times 10^{-4}$ mols/mol of AgX |

BS-1

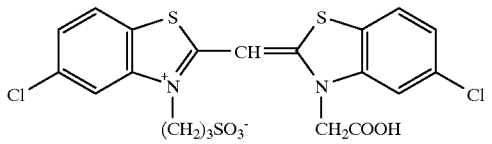

BS-2

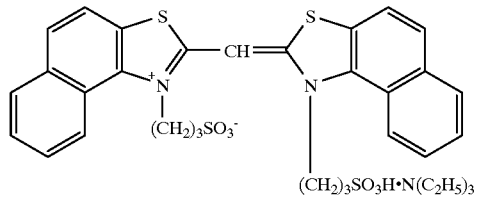

GS-1

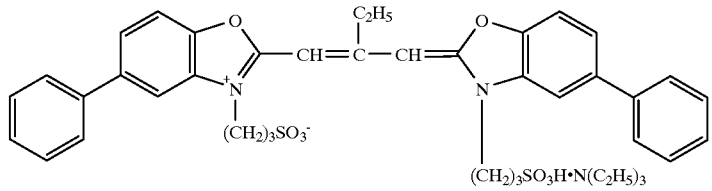

RS-1

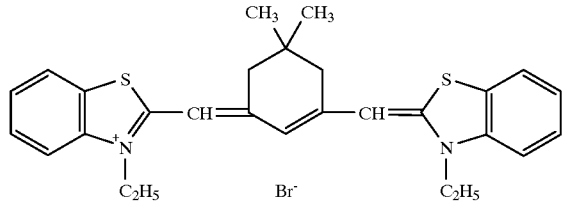

STAB-1

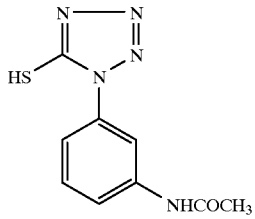

Samples 102 through 113 were prepared in the same manner as in Sample 101, except that coupler EM-1 used in Layer 3 was replaced by an equimolar amount of an inventive coupler or comparative coupler and dye image stabilizer was replaced by ones as shown in Table 2.

The resulting Samples 101 through 113 were exposed to green light through a wedge in an ordinary method and were then processed according to the following steps.

| Processing step | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30° C. to 34° C. | 90 sec. |
| Drying | 60° C. to 80° C. | 60 sec. |

The compositions of the processing solutions used in each of the processing steps were as follows. The replenishing rate of each processing solution was 80 cc per $m^2$ of the photographic material.

Color developer:

| | Tank soln. | Replenisher |
|---|---|---|
| Water | 800 ml | 800 ml |
| Triethanol amine | 10 g | 18 g |
| N,N-diethyl hydroxylamine | 5 g | 9 g |
| Potassium chloride | 2.4 g | — |
| 1-Hydroxyethylidene-1,1-diphosphonic acid | 1.0 g | 1.8 g |
| 3-Methyl-4-amino-N-ethyl-N-(β-methane sulfonamido ethyl)aniline | 5.4 g | 8.2 g |
| Fluorescent whitening agent (4,4'-diamino stilbene sulfonic acid derivative) | 1.0 g | 1.8 g |
| Potassium carbonate | 27 g | 27 g |
| Add water to make in total of | 1,000 cc | |

The pH of the tank solution and replenisher were adjusted to 10.10 and 10.60, respectively.

Bleach-fixer:

| (A tank solution and replenisher were the same.) | |
|---|---|
| Ferric ammonium ethylenediamine tetraacetate, dihydrate | 60 g |
| Ethylenediamine tetraacetic acid | 3 g |
| Ammonium thiosulfate (in an aqueous 70% solution) | 100 cc |
| Ammonium sulfite (in an aqueous 40% solution) | 27.5 cc |
| Add water to make in total of | 1,000 cc |
| Adjust pH with potassium carbonate or glacial acetic acid to be | 5.7 |

Stabilizer:

| (A tank solution and replenisher ere the same.) | |
|---|---|
| 5-Chloro-2-methyl-4-isothiazoline-3-one | 1 g |
| Ethylene glycol | 1 g |
| 1-Hydroxyethylidene-1,1-diphoshonic acid | 2 g |
| Ethylenediamine tetraacetic acid | 1 g |
| Ammonium hydroxide (in an aqueous 20% solution) | 3 g |
| Fluorescent whitening agent (4,4'-diamino stilbene sulfonic acid derivative) | 1.5 g |
| Add water to make in total of | 1,000 cc |
| Adjust pH with sulfuric acid or potassium hydroxide to be | 7.0 |

After running continuous processing, each sample was evaluated with respect to the following items.

Dmax:

The maximum density of each sample was measured.

Light fastness:

Processed samples each were subjected to light exposure over a period of 7 days, using a xenon Fade-O-meter. Residual color density of the dye image at an initial density of 1.0 was measured and the light fastness was evaluated in terms of the residual dye ratio (%), based on the initial density of 1.0.

Results thereof are shown in Table 2.

TABLE 2

| Sample No. | Magenta coupler | Dye image stabilizer | Dmax | Residual dye ratio (%) | Remarks |
|---|---|---|---|---|---|
| 101 | EM-1 | ST-3(1) + B-3(1)* | 1.92 | 59 | Comp. |
| 102 | EM-1 | — | 1.87 | 40 | Comp. |
| 103 | EM-2 | ST-3(1) + B-3(1) | 2.10 | 68 | Comp. |
| 104 | EM-2 | — | 2.12 | 47 | Comp. |
| 105 | M-1 | — | 2.58 | 80 | Inv. |
| 106 | M-6 | — | 2.48 | 81 | Inv. |
| 107 | M-13 | — | 2.52 | 81 | Inv. |
| 108 | M-18 | — | 2.45 | 80 | Inv |
| 109 | M-22 | — | 2.54 | 83 | Inv. |
| 110 | M-26 | — | 2.52 | 82 | Inv. |
| 111 | M-1 | ST-3(1) + B-3(1) | 2.55 | 88 | Inv. |
| 112 | M-13 | ST-3(1) + B-3(1) | 2.57 | 87 | Inv. |
| 113 | M-26 | ST-3(1) + B-3(1) | 2.54 | 90 | Inv. |

*: Values in parenthese are a molar ratio of stabilizer to magenta coupler.

As can be seen from Table 2, the use of magenta couplers of the invention led to markedly improved results in light fastness, as compared to comparative couplers. In addition, the use of the inventive coupler in combination with the dye image stabilizer led to further enhanced results.

What is claimed is:

1. A silver halide color photographic light sensitive material comprising a support having thereon photographic component layers including a blue-sensitive silver halide emulsion layer, green-sensitive silver halide emulsion layer and a red-sensitive silver halide emulsion layer, wherein said green-sensitive silver halide emulsion layer comprises a magenta coupler represented by the following formula (M):

formula (M)

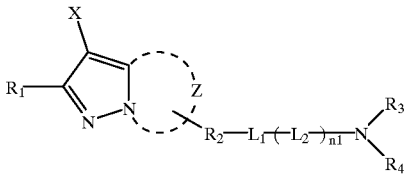

wherein $R_1$ represents a substituent; $R_2$ represent an alkylene group or arylene group; $R_3$ an alkyl group containing a hydroxy group; $R_4$ represents a hydrogen atom, alkyl group or alkyl group containing a hydroxy group, provided that a total number of the hydroxy group contained in $R_3$ and $R_4$ is 2 or 3; $L_1$ represents a bivalent linking group selected from the group consisting of —O—, —S— and —CO—; $L_2$ represents a bivalent linking group selected from the group consisting of —O—, —S—, —CO—, —$SO_2$—, —$NR_5$—, an alkylene group and arylene group, in which $R_5$ represents a hydrogen atom, alkyl group, aryl group, acyl group, sulfonyl group, alkoxycarbonyl group, aryloxycarbonyl group, carbamoyl group or sulfamoyl group; n1 is an integer of 0 to 20, provided that when n1 is 2 or more, plural $L_2$ may be the same or different from each other and an alkylene group is not directly linked to —$N(R_3)R_4$; X represents a hydrogen atom or a group capable of being released upon reaction with an oxidation product of a developing agent; and represents an atomic group necessary for forming a nitrogen-containing heterocyclic group.

2. The silver halide photographic material of claim 1, wherein said green-sensitive silver halide emulsion layer further comprises a compound represented by formula (A) or (B):

Formula (A)

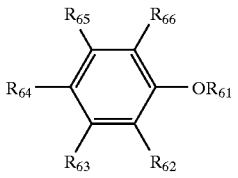

wherein $R_{61}$ represents a hydrogen atom, alkyl group, alkenyl group, aryl group, or heterocyclic group; $R_{62}$, $R_{63}$, $R_{65}$ and $R_{66}$ each represent a hydrogen atom, halogen atom, hydroxy group, alkyl group, alkenyl group, aryl group, alkoxy group, or acylamino group; $R_{64}$ represents an alkyl group, hydroxy group, aryl group, alkoxy group, alkenyloxy group, or aryloxy group, provided that $R_{61}$ and $R_{62}$ may combine with each other to form a 5 or 6-membered heterocyclic ring, and $R_{63}$ and $R_{64}$ may combine with each other to form a 5-membered ring;

Formula (B)

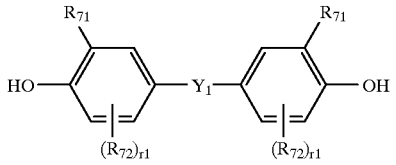

wherein $R_{71}$ represents a secondary or tertiary alkyl group, secondary or tertiary alkenyl group, cycloalkyl group or aryl group; $R_{72}$ represents a halogen atom, alkyl group, alkenyl group, cycloalkyl group or aryl group; r1 is an integer of 0 to 3; $Y_1$ represents —S—, —SO—, —$SO_2$— or an alkylene group.

* * * * *